United States Patent [19]

Stoltz et al.

[11] Patent Number: 4,974,282

[45] Date of Patent: Dec. 4, 1990

[54] UPHOLSTERY CLEANING SYSTEM

[75] Inventors: Lawrence E. Stoltz; Arlen M. Knight; William R. Hatchmann, all of Santa Barbara, Calif.

[73] Assignee: Kleen-Rite Upholstery & Carpet Cleaning System, Santa Barbara, Calif.

[21] Appl. No.: 438,079

[22] Filed: Nov. 20, 1989

[51] Int. Cl.[5] ..... A47L 7/00

[52] U.S. Cl. ..... 15/321; 15/322; 15/353

[58] Field of Search ..... 15/321, 353, 322, 320

[56] References Cited

U.S. PATENT DOCUMENTS 4,658,464 4/1987 Sharp ..... 15/321

*Primary Examiner*—Chris K. Moore

*Attorney, Agent, or Firm*—Kelly Bauersfeld & Lowry

[57] ABSTRACT

An improved cleaning system is provided for use in cleaning upholstery such as carpet, drapes, furniture coverings, etc. The system includes a cleaning unit having a solution tank for receiving a selected cleaning solution, in combination with a pump and associated flow lines for delivering the cleaning solution to a cleaning tool. The system further includes a vacuum unit having a vacuum tank and associated pump and hose for vacuuming excess cleaning solution and debris from an upholstered surface. A multiported control valve interconnects the cleaning unit with the vacuum unit for facilitating removal of cleaning solution from the solution tank and associated flow lines as well as the cleaning tool.

4 Claims, 2 Drawing Sheets

UPHOLSTERY CLEANING SYSTEM

BACKGROUND OF THE INVENTION

This invention relates generally to machines and systems for use in cleaning upholstery, such as carpets, draperies, furniture coverings, and the like. More particularly, this invention relates to an improved cleaning system and related machine designed for relatively quick and simple purge or flush removal of a selected cleaning solution from system components, thereby facilitating periodic use of different cleaning solutions which may be incompatible with each other.

Upholstery cleaning systems and related equipment components are, in general terms, relatively well-known in the art. Such systems commonly include a solution tank for receiving a supply of a selected cleaning solution, in combination with a pump and related flow lines for delivering the cleaning solution to an appropriate cleaning tool. The cleaning tool is normally designed for manual manipulation over a selected upholstery item or items to be cleaned. In this regard, the cleaning action provided by the solution is often enhanced by preheating and/or pressurizing the solution for delivery to the upholstery item, and/or by the use of brush or vibratory elements on the cleaning tool. Moreover, in some systems, the cleaning solution is delivered to the tool in a recirculation flow such that a portion of the solution is recycled on a continuous basis to the solution tank. At the conclusion of a cleaning procedure, a vacuum unit is typically employed to vacuum excess fluid and entrained debris from the upholstery. These equipment components are often provided in a convenient portable form carried on a common cart for easy transport directly to a site of use.

It is known that different types of cleaning solution are required for proper cleaning of different types of upholstery material. For example, many upholstery materials may be cleaned effectively and easily using a water based cleaning solution, whereas other types of upholstery material may be cleaned according to so-called "dry" cleaning procedures using a nonaqueous solution such as an appropriate petroleum based solvent or the like. Accordingly, to accommodate these different cleaning environments, it is often necessary to change from one type of cleaning solution to another. Unfortunately, aqueous and nonaqueous cleaning solutions are generally incompatible with each other and will tend to form a gelatinized sludge when intermixed. It is therefore necessary for a prior cleaning solution to be purged or flushed from the flow lines and tanks of the cleaning equipment before a different type of cleaning solution can be used. A failure to purge or flush the prior cleaning solution creates a substantial risk of malfunction due to clogged flow lines.

In the past, in recognition of the potential clogging problem, it has been necessary to remove the cleaning tool from its associated flow lines and then perform external interconnection of the solution flow lines and vacuum hose to purge the system components. However, this approach involves a series of manual steps which can be complicated and confusing to many machine operators, such that component purging is often performed improperly or not at all. Moreover, following this prior art approach, residual cleaning solution is not normally removed from the cleaning tool, with the result that the tool can become clogged or a small quantity of the incorrect cleaning solution can be delivered from the tool when cleaning operation is resumed.

There exists, therefore, a significant need for an improved cleaning system of the type including equipment for delivering and vacuuming cleaning solution, wherein the system includes relatively simple and easily operated means for flushing cleaning solution from the components and related flow lines thereby facilitating a change in cleaning solution type. The present invention fulfills these needs and provides further related advantages.

SUMMARY OF THE INVENTION

In accordance with the invention, an improved upholstery cleaning system includes a cleaning unit for receiving and circulating a selected cleaning solution to an upholstery material to be cleaned, in combination with a vacuum unit for vacuuming excess cleaning solution and debris from the upholstery material. A control valve selectively interconnects the cleaning and vacuum units, such that the vacuum unit directly purges residual cleaning solution from the cleaning unit, the cleaning tool, and associated flow lines.

In the preferred form of the invention, the cleaning and vacuum units are mounted on a common portable cart for relatively easy transportation as an integrated unit to a job site. The cleaning unit includes a solution tank for receiving a selected cleaning solution, together with a pump and related solution flow lines for delivering the cleaning solution to the cleaning tool. In one preferred geometry, the flow lines include a supply line and a return line for recirculation flow of the cleaning solution between the solution tank and tool. The vacuum unit includes a vacuum tank and related vacuum hose, together with a vacuum blower for creating a substantial suction action through the hose leading to the vacuum tank.

The control valve comprises a multiported valve assembly mounted in-line along a cleaning solution flow line, the control valve is further coupled to a purge line coupled to the vacuum tank of the vacuum unit. A manual control knob or the like, which may be mounted in an easily accessible position on the exterior of the system, is provided to switch the control valve according to the desired mode of system operation. For example, in a normal run mode, the control valve can be set to permit normal cleaning solution circulation flow, as described above. In a tank drain mode, the control valve can be set to connect the vacuum tank via the purge line with the solution tank and an associated portion of the solution flow lines for drawing cleaning solution into the vacuum tank. In a purge or flush mode, the control valve can connect the purge line with the remaining flow lines and the cleaning tool to draw cleaning solution therefrom.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
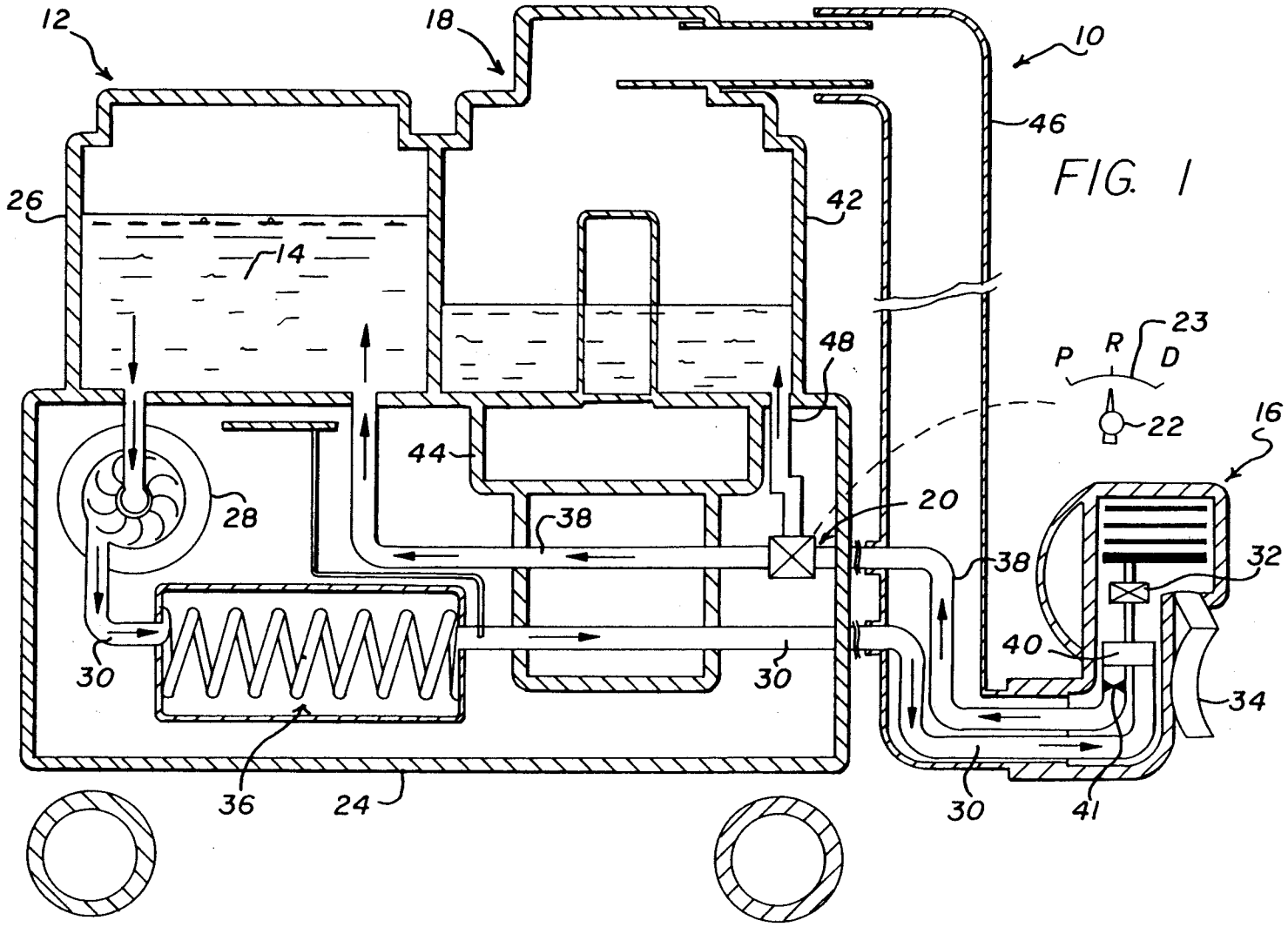
FIG. 1 is a somewhat diagrammatic view representing an upholstery cleaning system incorporating a multiported control valve embodying the novel features of the invention.

As shown in the exemplary drawings, an improved upholstery cleaning system referred to generally in FIG. 1 by the reference numeral 10 is provided for use in cleaning upholstery materials such as carpets, draperies, furniture coverings, etc. The system 10 includes a cleaning unit 12 for circulating a selected cleaning solution 14 to a cleaning tool 16, and a vacuum unit 18 for vacuuming excess cleaning solution and debris from an upholstered material. A control valve 20 is operated quickly and easily by adjustment of a control knob 22 or the like to select the mode of system operation. Importantly, the control valve 20 is adjustable to permit residual cleaning solution to be purged or flushed from the system.

The cleaning system of the present invention is particularly designed for broad utility in cleaning a wide variety of upholstery materials which may require use of different types of cleaning solutions, such as aqueous or nonaqueous based solutions. In this regard, it is often necessary to switch from one type of cleaning solution to another. However, since different types of cleaning solutions are typically incompatible with each other and can clog the system components if intermixed, it is desirable to purge the system of residual cleaning solution of one type prior to use of a cleaning solution of a different type. The control valve 20 of the present invention provides a simple and easily manipulated device which selectively interconnects the cleaning and vacuum units 12 and 18, such that residual cleaning solution can be purged from the system by operation of the vacuum unit.

As shown generally in FIG. 1, the illustrative cleaning system 10 includes a combination of relatively conventional components together with the control valve 20, as will be described in more detail. More particularly, FIG. 1 shows the cleaning and vacuum units 12 and 18 mounted in general side-by-side relation on a common wheeled cart 24 for convenient portability to a site of use to clean selected upholstery material or materials. The cleaning unit 12 includes a solution tank 26 adapted to receive a selected liquid cleaning solution 14, such as an aqueous-based solution or a so-called "dry" cleaning solution in the form of a petroleum solvent or the like. A solution pump 28 is provided to draw the cleaning solution 14 from the tank 26 for delivery through a supply flow line 30 to the cleaning tool 16. This cleaning tool 16 may take any convenient form adapted for movement over or in close proximity with an upholstery material to deliver the cleaning solution 14 thereto. A supply valve 32 operated by a manual lever 34 or the like on the tool 16 are typically provided to assist in cleaning solution delivery control relative to the material to be cleaned. Moreover, a heat exchanger 36 with appropriate heat source means may be provided along the supply line 30 for preheating the solution, if desired.

FIG. 1 further illustrates the cleaning system to include a return flow line 38 coupled to the supply line 30 via a Y-fitting 40 or the like, normally at a location close to but slightly upstream from the tool valve 32. A restrictor orifice 41 in the return line 38 regulates the entry of cleaning solution thereinto for recirculation to the solution tank 26. However, it will be understood by those skilled in the art that recirculation of cleaning solution to the tank 26 is not required and is not provided in all types of cleaning systems.

The vacuum unit 18 includes a vacuum tank 42 associated with a vacuum motor or blower 44 for drawing fluid into the tank 42 through an elongated vacuum hose 46. In this regard, as is shown in the unit, the vacuum hose 46 is used during normal cleaning procedures to vacuum residual cleaning solution on an upholstery material together with loosened dirt and debris into the vacuum tank 42. Appropriate controls for the cleaning unit 12 and the vacuum unit 18 are conventional in form and are normal mounted in easily accessible portions on the exterior of the cart 24, and thus are not shown and described herein.

The control valve 20 comprises a multiported valve assembly mounted in-line with a flow line of the cleaning unit 12, with FIG. 1 showing the valve 20 mounted along the length of the return flow line 38. The control valve 20 normally permits unrestricted cleaning solution flow through the return line 38 for normal operation, as described above. However, the control valve can be switched to alternate operating modes to reroute flow of cleaning solution to the vacuum tank 42 via a short purge line 48. This rerouting of cleaning solution flow effectively interconnects the cleaning and vacuum units 12 and 18 for purposes of purging cleaning solution from the cleaning unit 12. Such purging is particularly important in permitting and facilitating removal of residual cleaning solution of one type, such that the system may be charged with and use a different type of cleaning solution.

Figure 2:
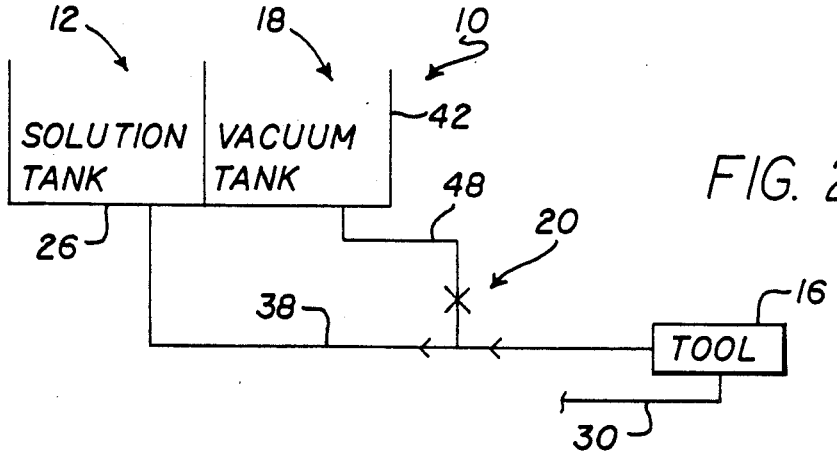
FIG. 2 is a schematic diagram of the system wherein the control valve is set for normal recirculatory supply of a selected cleaning solution.

More specifically, as shown schematically in FIG. 2, the control valve 20 can be set for normal return circulation flow of the cleaning solution through the return line 38 to the solution tank 26 for recycling. In this normal "run" mode, referred to by the letter "R" on the scale 23 adjacent the control knob 22 (FIG. 1), the purge line 48 is closed by the control valve. Accordingly, during normal "run" operation, the vacuum tank 42 is isolated from the return flow line 38.

Figure 3:
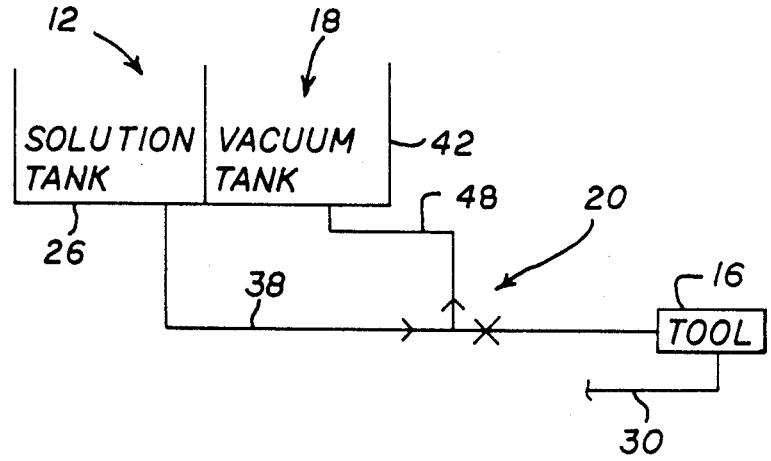
FIG. 3 is a schematic diagram similar to FIG. 2, but illustrating the control valve set for draining cleaning solution from a solution tank.

When a cleaning procedure is completed, or when it is desirable to change to a different type of cleaning solution, the control valve 20 can be set at a "drain" setting as viewed in FIG. 3, and as depicted by the letter "D" in FIG. 1. In this "drain" setting, the control valve 20 is reset to open the purge line 48 for flow communication with the portion of the return line 38 leading to the solution tank 26. In this configuration, the opposite portion of the return line 38 leading to the cleaning tool 16 is closed by the control valve. The vacuum unit 18 can than be operated to draw cleaning solution 14 from the solution tank 26 and the adjacent portion of the flow line 38, wherein the drawn cleaning solution is collected within the vacuum tank 42 for disposal or the like. The vacuuming step is normally undertaken with the vacuum hose 46 disconnected and its mounting site on the vacuum tank closed.

Figure 4:
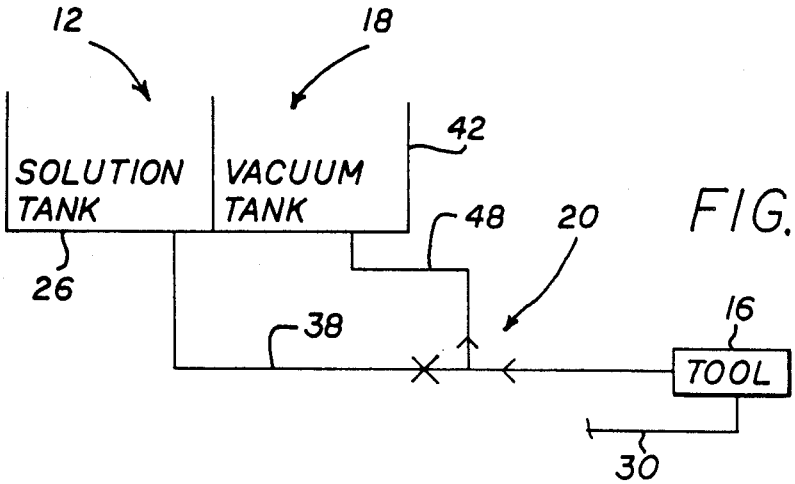
FIG. 4 is a schematic diagram similar to FIGS. 2 and 3, but illustrating the control valve set for flushing or purging cleaning solution from the system flow lines.

Subsequent to draining of the solution tank 26, the control valve 20 can be reset to a "purge" setting as shown in FIG. 4, and as referred to by the letter "P" in FIG. 1, for purposes of removing residual cleaning solution from the remaining portion of the flow line 38 and from the cleaning tool 16. More particularly, the control valve 20 is reset to close the flow line 38 leading to the solution tank 26, while opening the flow line portion leading to the cleaning tool 16. In this configuration, resumed operation of the vacuum unit 18 draws residual cleaning solution from the line 38, the tool 16, and further from the supply line 30 and/or from components installed along the supply line. The system flow lines and components are thus substantially completely evacuated to permit switching to another type of cleaning solution with little or no risk of system clogging. The residual solution collection with the vacuum tank 42 may be discarded or otherwise transferred to an appropriate storage vessel for later reuse.

When the system is charged with a new cleaning solution, it is desirable initially to operate the system in the purge mode depicted in FIG. 4. In this mode, the vacuum unit 18 assists in priming the system flow lines for drawing solution into the vacuum tank 42. When solution begins to flow into the vacuum tank, the control knob 22 can be switched to the "run" mode position for normal system operation.

The cleaning system of the present invention thus provides a versatile upholstery cleaning arrangement including traditional cleaning and vacuum units, but in combination with the multiposition, multiported control valve 20 which permits rapid system purging of cleaning solution, for correspondingly permitting rapid changeover between cleaning solutions of different types.

A variety of further modifications and improvements to the invention will be apparent to those skilled In the art. Accordingly, no limitation on the invention is intended by way of the foregoing description and the accompanying drawings, except as set forth in the appended claims.

What is claimed is:

1. An upholstery cleaning system, comprising:

a cleaning unit having a solution tank for receiving a supply of a selected cleaning solution, a cleaning tool, a flow line coupled between said solution tank and said tool, and means for delivering cleaning solution from said solution tank to said tool;

a vacuum unit having a vacuum tank, a vacuum hose coupled to said vacuum tank, and a vacuum blower for drawing cleaning solution through said hose into said vacuum tank; and control valve means mounted along said flow line and coupled to said vacuum tank, said control valve means including a control valve operable in a first position to permit flow of the cleaning solution through said flow line in isolation from said vacuum tank, and a second position coupling said vacuum tank to said flow line to purge cleaning solution from said flow line;

said flow line including a supply line and a recirculation return line connected between said solution tank and said cleaning tool, said control valve means being connected along said return line.

2. An upholstery cleaning system comprising:

a cleaning unit having a solution tank for receiving a supply of a selected cleaning solution, a cleaning tool, a flow line coupled between said solution tank and said tool, and means for delivering cleaning solution from said solution tank to said tool;

a vacuum unit having a vacuum tank, a vacuum hose coupled to said vacuum tank, and a vacuum blower for drawing cleaning solution through said hose into said vacuum tank; and control valve means mounted along said flow line and coupled to said vacuum tank, said control valve means including a control valve operable in a first position to permit flow of the cleaning solution through said flow line in isolation from said vacuum tank, a drain mode position to draw cleaning solution from said solution tank to said vacuum tank, and a purge mode position to draw cleaning solution from said cleaning tool to said vacuum tank.

3. An upholstery cleaning system, comprising:

a cleaning unit having a solution tank for receiving a supply of a selected cleaning solution, a cleaning tool, a flow line coupled between said solution tank and said tool, and pump means for delivering cleaning solution from said solution tank to said tool;

a vacuum unit having a vacuum tank, a vacuum hose coupled to said vacuum tank and a vacuum blower for drawing cleaning solution through said hose into said vacuum tank; and means for selectively interconnecting said vacuum tank with said flow line to purge cleaning solution from said flow line and said cleaning tool and said solution tank by drawing the cleaning solution into said vacuum tank.

4. An upholstery cleaning system comprising;

a cleaning unit having a solution tank for receiving a supply of a selected cleaning solution, a cleaning tool, a flow line coupled between said solution tank and said tool, and pump means for delivering cleaning solution from said solution tank to said tool;

a vacuum unit having a vacuum tank, a vacuum hose coupled to said vacuum tank, and a vacuum blower for drawing cleaning solution through said hose into said vacuum tank;

a purge line; and a three way control valve connected along said flow line and to said purge line, said purge line extending between said control valve and said vacuum tank;

said control valve including valve means for closing said purge line and defining a flow path for cleaning solution flow along said flow line during a normal operating mode, for opening said purge line and closing the portion of the flow line leading to said tool during a drain mode such that cleaning solution within said solution tank is drawn through said purge line into said vacuum tank, and for closing the portion of the flow line leading to said solution tank and for opening the flow line portion leading to said tool during a purge mode such that cleaning solution within said tool is drawn through said purge line into said vacuum tank.

* * * * *